United States Patent [19]

Franz

[11] 4,144,090

[45] Mar. 13, 1979

[54] NON-OXIDATIVE REMOVAL OF GOLD FILMS

[75] Inventor: Helmut Franz, Pittsburgh, Pa.

[73] Assignee: PPG Industries, Inc., Pittsburgh, Pa.

[21] Appl. No.: 844,943

[22] Filed: Oct. 25, 1977

[51] Int. Cl.[2] ..... B08B 3/08

[52] U.S. Cl. ..... 134/3; 134/10; 252/142; 252/DIG. 10

[58] Field of Search ..... 134/3, 10, 28; 75/118 R; 252/79.2, DIG. 10, 142; 156/664

[56] References Cited

U.S. PATENT DOCUMENTS

| | | | |
|---|---|---|---|
| 2,283,198 | 5/1942 | Fink et al. | 75/118 R X |
| 2,978,366 | 4/1961 | Harwig et al. | 134/3 |
| 3,495,976 | 2/1970 | Bazilevsky et al. | 134/3 X |
| 3,764,650 | 10/1973 | Scheiner et al. | 75/118 R X |
| 3,935,005 | 1/1976 | Solidum et al. | 75/118 R X |
| 3,957,505 | 5/1976 | Homick et al. | 75/118 R X |

*Primary Examiner*—Marc L. Caroff
*Attorney, Agent, or Firm*—Donna L. Seidel

[57] ABSTRACT

A gold film is debonded from a glass substrate without oxidizing and dissolving the gold by contacting the metallic gold-coated substrate with an aqueous sulfuric acid solution consisting essentially of a soluble halide selected from the group consisting of alkali metal halides, alkaline earth metal halides, ammonium halides and hydrogen halides.

6 Claims, No Drawings

NON-OXIDATIVE REMOVAL OF GOLD FILMS

BACKGROUND OF THE INVENTION

1. Field of the Invention

The present invention relates generally to the removal of gold films from gold-plated articles and, more particularly, to the stripping of gold films without oxidizing or dissolving the gold.

2. Discussion of the Prior Art

U.S. Pat. No. 3,242,090 to Grunwald describes prior methods of stripping gold such as electrolytic procedures wherein the gold-plated article is used as an anode in an aqueous solution of sulfuric acid, and chemical procedures wherein a solution of a cyanide and an oxidizing agent such as hydrogen peroxide is used to oxidize and dissolve the gold. The method claimed by Grunwald involves the improvement of using certain complex cyanides, especially complex tetracyanide anions, in combination with suitable oxidizing agents.

Generally, gold films are removed from coated articles only by dissolving the metal in strong oxidizing media such as aqua regia, a mixture of hydrochloric and nitric acids which generates active chlorine, or in strong complexing cyanide solutions in combination with oxygen. The above-described media develop noxious fumes, are poisonous and hazardous, and are therefore undesirable for stripping gold films under production line conditions. As an alternative, a gold film may be removed by wiping it from the substrate. However, this technique is effective only with fresh gold films prepared by electroless deposition and, in addition, recovery of the gold is difficult.

SUMMARY OF THE INVENTION

The present invention provides a method for stripping a gold film from a gold coated article by debonding the film using an acidic solution of halide ions and recovering the gold as flakes of gold metal. An aqueous solution of chloride ions is preferred.

A soluble chloride, such as sodium chloride or ammonium chloride, is dissolved in a dilute acid such as sulfuric acid. The solution is applied to the gold-coated surface of an article. Within seconds, the gold film is debonded from the glass surface. The debonded gold can be swept from the surface with a squeegee or a rinse and collected as flakes of metal in a settling tank or by filtration.

DETAILED DESCRIPTION OF THE PREFERRED EMBODIMENT

In the production of gold-coated architectural glass products, a certain proportion of the coated articles will fail to meet the high standards of optical uniformity set for commercial products. Since gold is very expensive, it is desirable to reclaim the precious metal from the rejected article for reuse in the coating operation.

The present invention provides a method for on-line gold stripping which removes the gold film by debonding the metal from the glass surface rather than dissolving it in hazardous solutions such as those containing nascent chlorine or cyanide.

The solution used to debond the gold film from the glass surface is preferably a dilute solution of a soluble halide, preferably a chloride, in a dilute acid. The solution typically contains from about 0.1 to about 10 percent, preferably about 1 to 5 percent, of a soluble chloride such as an alkali metal or alkaline earth metal chloride. The preferred chlorides include sodium chloride, potassium chloride, magnesium chloride, ammonium chloride and hydrogen chloride. The solution is rendered acidic by the presence of about 0.1 to 10 percent, preferably about 1 to 5 percent, of a common strong acid such as sulfuric acid. Higher concentrations of chloride or acid can be used but are unnecessary and make the solution less desirable to work with.

The stripping solution is preferably sprayed onto the gold-coated surface and contained in place between two rubber squeegees. The gold film debonds from the surface within seconds. The gold metal flakes are swept from the surface by a spray rinse, by a squeegee or by any means of physically removing the solution carrying the gold flakes from the surface of the substrate. The gold flakes are then recovered by physically separating the gold flakes from the solution. Preferably the solution is held in a settling tank and then filtered to recover the gold metal flakes.

In a most preferred stripping operation, brushes, top and bottom surface rinses, and an additional squeegee on the bottom surface may be employed to insure that no gold flakes adhere to either surface of the glass. These improvements help to minimize loss of gold metal in the recovery operation.

The present invention will be further understood from the description of the specific example which follows.

EXAMPLE

Flat sheets are coated with gold by contacting an activated glass surface substantially simultaneously with a first solution of a gold salt and a complexing agent and a second solution of a reducing agent for gold ions. Any gold coated glass sheets which do not meet the product specifications are stripped of the gold film as follows.

A solution of 3 percent sodium chloride in 3 percent aqueous sulfuric acid is sprayed onto the gold coated surface. The gold film is debonded in about 5 seconds. The stripping solution containing the debonded gold as flakes of metal is swept from the sheet with a squeegee and filtered to recover the gold flakes.

The above example is offered to illustrate the present invention. The invention may be modified in various ways. For example, higher concentrations of acid may be used with lower concentrations of chloride ions or vice versa. Gold films may be removed from substrates other than flat glass sheets. Other halide ions may be substituted for chloride, with the exception that fluoride ions should not be used to remove a gold film from glass if it is desired to reuse the glass since fluoride ions visibly etch the glass surface. Gold films deposited by various methods such as vapor deposition, electroplating or electroless deposition may be removed according to the present invention. These and other variations are included within the scope of the invention which is defined by the following claims.

What is claimed is:

1. A method for debonding a gold film from a metallic gold-coated surface of a glass article as flakes of gold metal comprising contacting the gold-coated surface with an acidic aqueous solution consisting essentially of a soluble halide selected from the group consisting of alkali metal halides, alkaline earth metal halides, ammonium halides and hydrogen halides, said halide being present in said solution in an amount sufficient to debond the metallic gold from the surface of the article.

2. The method according to claim 1, wherein the halide is a soluble chloride selected from the group consisting of sodium chloride, potassium chloride, magnesium chloride, ammonium chloride and hydrogen chloride.

3. The method according to claim 2, wherein the solution consists essentially of:

a. from about 1 to about 5 percent of a soluble chloride selected from the group consisting of sodium chloride and ammonium chloride; and b. from about 1 to about 5 percent sulfuric acid.

4. A method for recovering metallic gold from a metallic gold-coated surface of a glass article comprising the steps of:

a. contacting the gold-coated surface with an acidic aqueous solution consisting essentially of a soluble halide selected from the group consisting of alkali metal halides, alkaline earth metal halides, ammonium halides, and hydrogen halides, said halide being present in said solution in an amount sufficient to debond the metallic gold as flakes of gold metal from the surface of the article;

b. removing the solution carrying the debonded metallic gold as flakes of gold metal from the surface of the article; and c. physically separating the metallic gold flakes from the solution.

5. The method according to claim 4, wherein the solution consists essentially of a soluble chloride selected from the group consisting of sodium chloride, ammonium chloride and hydrogen chloride.

6. The method according to claim 5, wherein the solution consists essentially of:

a. from about 1 to about 5 percent of a soluble chloride selected from the group consisting of sodium chloride and ammonium chloride; and b. from about 1 to about 5 percent sulfuric acid.

* * * * *